US012152448B2

(12) United States Patent
Shan et al.

(10) Patent No.: US 12,152,448 B2
(45) Date of Patent: Nov. 26, 2024

(54) COILED TUBING OPERATING SYSTEM AND COILED TUBING OPERATING METHOD

(71) Applicant: SICHUAN HONGHUA PETROLEUM EQUIPMENT CO., LTD, Sichuan (CN)

(72) Inventors: Daiwei Shan, Sichuan (CN); Hongke Xia, Sichuan (CN); Lin Zeng, Sichuan (CN); Zhangjie Ming, Sichuan (CN); Youyuan Cheng, Sichuan (CN); Yu Tian, Sichuan (CN); Aimin Tang, Sichuan (CN); Bin Liu, Sichuan (CN)

(73) Assignee: SICHUAN HONGHUA PETROLEUM EQUIPMENT CO., LTD, Sichuan (CN)

( * ) Notice: Subject to any disclaimer, the term of this patent is extended or adjusted under 35 U.S.C. 154(b) by 200 days.

(21) Appl. No.: 17/983,149

(22) Filed: Nov. 8, 2022

(65) Prior Publication Data

US 2023/0076707 A1 Mar. 9, 2023

(30) Foreign Application Priority Data

Nov. 30, 2021 (CN) ..... 202111449623.3

(51) Int. Cl.
*E21B 19/22* (2006.01)
*E21B 19/00* (2006.01)
*E21B 44/02* (2006.01)

(52) U.S. Cl.
CPC ..... *E21B 19/22* (2013.01); *E21B 19/008* (2013.01); *E21B 44/02* (2013.01)

(58) Field of Classification Search
CPC ..... E21B 19/22
See application file for complete search history.

(56) References Cited

U.S. PATENT DOCUMENTS 10,329,858 B1 * 6/2019 He ..... E21B 19/22
2005/0263281 A1 * 12/2005 Lovell ..... E21B 23/12 166/250.07
2008/0264649 A1 * 10/2008 Crawford ..... E21B 19/22 166/381
2015/0141190 A1 * 5/2015 White ..... B66D 1/24 475/149
2016/0097244 A1 * 4/2016 Livescu ..... C23C 8/68 148/279
2016/0168978 A1 * 6/2016 Kozak ..... E21B 47/04 73/152.44
2017/0260817 A1 * 9/2017 Dobkins ..... E21B 19/08
(Continued)

*Primary Examiner* — Giovanna Wright

(57) ABSTRACT

A coiled tubing operating system and a coiled tubing operating method are provided, which relate to a technical field of coiled tubing. The coiled tubing operating system includes: an injector assembly for lifting or lowering a coiled tube; a suspending device for suspending the injector assembly; a reel assembly for feeding the coiled tube to the injector assembly, and for rewinding the coiled tube from the injector assembly; and a circuit control system connected to the injector assembly and the reel assembly, for controlling movements of the injector assembly and the reel assembly. The system can ensure the stability of the coiled tubing, the precision of equipment control, and reduction of the environment pollution.

15 Claims, 13 Drawing Sheets

(56) References Cited

U.S. PATENT DOCUMENTS

| | | | | |
|---|---|---|---|---|
| 2018/0023731 | A1* | 1/2018 | Varkey | F16L 11/127<br>138/108 |
| 2019/0071941 | A1* | 3/2019 | Dobkins | E21B 44/02 |
| 2021/0301630 | A1* | 9/2021 | Krippner | E21B 41/0085 |
| 2022/0290514 | A1* | 9/2022 | Behrens | E21B 4/003 |

* cited by examiner

COILED TUBING OPERATING SYSTEM AND COILED TUBING OPERATING METHOD

CROSS REFERENCE OF RELATED APPLICATION

The present invention claims priority under 35 U.S.C. 119(a-d) to CN 202111449623.3, filed Nov. 30, 2021.

BACKGROUND OF THE PRESENT INVENTION

Field of Invention

The present invention relates to a technical field of coiled tubing, and more particularly to a coiled tubing operating system and a coiled tubing operating method.

Description of Related Arts

With the continuous enrichment and improvement of different types of coiled tubing machines, coiled tubing tools, and completion equipment, the advantages of coiled tubing technology are more and more obvious. The application scope of coiled tubing technology has covered drilling, logging, perforation, stimulation, well workover, acidizing, fracturing, etc.

Conventional coiled tubing operating system is generally controlled by hydraulic transmission, while the hydraulic transmission is sensitive to changes in oil temperature, which affects the working stability of the coiled tubing equipment, thus making the positioning of hydraulic control inaccurate. Furthermore, if leak occurs, it is easy to pollute the environment.

SUMMARY OF THE PRESENT INVENTION

An object of the present invention is to provide a coiled tubing operating system and a coiled tubing operating method, thereby solving problems in the prior art that when conventional coiled tubing operating system is in operation, stability of coiled tubing equipment is poor, positioning of hydraulic control is inaccurate, and it is easy to pollute environment.

Accordingly, in order to accomplish the above objects, the present invention provides:

a coiled tubing operating system, comprising:

an injector assembly for lifting or lowering a coiled tube;

a suspending device for suspending the injector assembly;

a reel assembly for feeding the coiled tube to the injector assembly, and for rewinding the coiled tube from the injector assembly; and a circuit control system connected to the injector assembly and the reel assembly, for controlling movements of the injector assembly and the reel assembly.

According to the coiled tubing operating system of the present invention (hereinafter referred to as the system), the suspending device can suspend the injector assembly above an operation well, so that during coiled tubing, the reel assembly can feed the coiled tube to the injector assembly, thereby lowering the coiled tube into the operation well through the injector assembly. After the coiled tubing is completed, the coiled tube is lifted by the injector assembly from the operation well and is rewound by the reel assembly. The system controls and drives the injector assembly and the reel assembly through the circuit control system. Compared with conventional hydraulic transmission method, control precision of the circuit control system is higher, working stability of the injector assembly and the reel assembly is better, and environment pollution is reduced.

Therefore, the system can ensure the stability of the coiled tubing, the precision of equipment control, and reduction of the environment pollution.

Preferably, the coiled tubing operating system further comprises an electric control room, and a generator for powering the circuit control system;

wherein the circuit control system comprises an operation platform, and the operation platform is installed in the electric control room.

Preferably, the coiled tubing operating system further comprises a power switching device, wherein the circuit control system is connected to an external grid through the power switching device, or the circuit control system is connected to the generator through the power switching device.

Preferably, when the external grid exists, the external grid is connected to the circuit control system through the generator.

Preferably, the coiled tubing operating system further comprises a hydraulic station connected to the injector assembly and/or the reel assembly, wherein a control unit of the hydraulic station is connected to the circuit control system, and the circuit control system controls the movements of the injector assembly and/or the reel assembly through the hydraulic station.

Preferably, the hydraulic station comprises a cable drum, a hose reel and a hydraulic pump, wherein the cable drum is used for winding cables, and the hose reel is used for winding hydraulic hoses; the circuit control system is electrically connected to the hydraulic pump, so as to control the movements of the injector assembly and/or the reel assembly through the hydraulic pump.

Preferably, the injector assembly comprises a driving device, a transmission assembly and an electric clamping system, wherein the driving device drives the transmission assembly to move, thereby lifting or lowering the coiled tube; during lifting or lowering of the coiled tube, the electric clamping system clamps the coiled tube.

Preferably, the reel assembly comprises an oil tube reel and a levelwind; wherein the oil tube reel comprises a reel drive, and the levelwind comprises a levelwind drive; the levelwind drive adjusts a position of the coiled tube in the oil tube reel; the oil tube reel rewinds the coiled tube from the injector assembly or from a yard spooler through the reel drive; both the reel drive and the levelwind drive adopt drive motors.

Preferably, the levelwind further comprises a tubing counting device, a one-stage chain transmission group, a bidirectional screw rod, a levelwind trolley, and a levelwind arm;

wherein the levelwind drive is drivingly connected to the one-stage chain transmission group;

the one-stage chain transmission group is connected to the bidirectional screw rod, and the bidirectional screw rod is rotatably connected to the levelwind arm;

the levelwind trolley is connected to the bidirectional screw rod, and is is slidably placed on the levelwind arm;

the tubing counting device is located on the levelwind trolley;

the levelwind drive is connected to a tubing encoder and a tubing brake;

the tubing encoder communicates with the levelwind drive and the tubing counting device to measure a rotating speed of the levelwind drive; and the tubing brake communicates with the levelwind drive and the tubing counting device.

Preferably, the coiled tubing operating system further comprises a yard spooler, which comprises a first support shaft, a working motor, a first support shaft assembly and a second support shaft assembly, wherein the first support shaft is used to rotate a drum, and the working motor is drivingly connected to the first support shaft;

the first support shaft assembly comprises a transmission mechanism and the first support shaft; the working motor is drivingly connected to the first support shaft through the transmission mechanism;

the second support shaft assembly is arranged apart from the first support shaft assembly, and comprises a second support shaft; wherein the second support shaft is coaxial with the first support shaft, and an installation area for the dump is formed between the first support shaft and the second support shaft.

Preferably, the coiled tubing operating system further comprises a well control system, wherein the well control system is installed below the injector assembly, and is used to monitor and forecast drilling parameters, well kicks and blowouts; the well control system is connected to the circuit control system.

Preferably, the coiled tubing operating system further comprises a support platform, wherein a traveling wheel is provided on one end of the support platform, and a connecting piece is provided on the other end of the support platform for connecting to a trailer; both the reel assembly and the electric control room are installed on the support platform;

the suspending device is a crane.

Preferably, the coiled tubing operating system further comprises an installation skid, wherein the installation skid has an injector installation area and a well control installation area; the injector assembly is installed in the injector installation area, and a well control system is installed in the well control installation area.

The present invention further provides a coiled tubing operating method based on the coiled tubing operating system as recited in claim 1, comprising steps of:

S1, establishing the coiled tubing operating system, and completing preparatory work before entering an operation well;

S2, according to target operation requirements, setting corresponding operation parameters in the circuit control system;

S3, lowering the coiled tube to a designated position through the injector assembly for operation;

S4, after the operation is completed, lifting the coiled tube to a wellhead of the operation well through the injector assembly; and S5, closing the operation well, and disassembling the coiled tubing operating system.

The coiled tubing operating method of the present invention (hereinafter referred to as the method) is based on the above system. The method controls and drives the injector assembly and the reel assembly through the circuit control system. Compared with conventional hydraulic transmission method, control precision of the circuit control system is higher, working stability of the injector assembly and the reel assembly is better, and environment pollution is reduced. Therefore, the method can ensure the stability of the coiled tubing, the precision of equipment control, and reduction of the environment pollution.

Preferably, a load sensor is installed on the injector assembly, which is used to monitor a load of the coiled tube during lowering or lifting, and then feed back a load signal to the circuit control system;

the circuit control system judges whether to continue lowering or lifting the coiled tube according to the load signal, so as to prevent the coiled tube from being stuck due to continuous lowering or lifting after encountering a resistance.

Preferably, a depth-measuring encoder is installed on the injector assembly, which is used to monitor a height of the coiled tube during lowering or lifting, and then feed back a height signal to the circuit control system;

the circuit control system judges whether to continue lowering or lifting the coiled tube according to the height signal, so as to prevent the coiled tube from being excessively lowered or lifted.

Preferably, a pressure sensor is installed on the injector head assembly, which is used to detect a clamping force of a clamping system of the injector assembly, and then feed back a clamping force signal to the circuit control system;

the circuit control system adjusts the clamping force of the clamping system of the injector assembly according to the clamping force signal.

To sum up, with the above technical solutions, beneficial effects of the present invention are as follows.

1. According to the coiled tubing operating system of the present invention, the suspending device can suspend the injector assembly above an operation well, so that during coiled tubing operating, the reel assembly can feed the coiled tube to the injector assembly, thereby lowering the coiled tube into the operation well through the injector assembly. After the coiled tubing operating is completed, the coiled tube is lifted by the injector assembly from the operation well and is rewound by the reel assembly. The system controls and drives the injector assembly and the reel assembly through the circuit control system. Compared with conventional hydraulic transmission method, control precision of the circuit control system is higher, working stability of the injector assembly and the reel assembly is better, and environment pollution is reduced.

2. The coiled tubing operating system of the present invention further comprises the electric control room, the generator and the power switching device, so that the system can be directly connected to and operated under the external grid. When the external grid fails, or when there is no external grid, the generator can supply power to the system. In addition, when there is an external grid, the external grid is connected to the circuit control system through the generator, so that when the external grid suddenly fails, the power source can be quickly switched to the generator to supply power to the system.

3. The coiled tubing operating system of the present invention further comprises the hydraulic station, and the circuit control system cooperates with the hydraulic station to control executive elements of the system. Compared with a control method in which the executive elements are entirely controlled by the circuit control system, cooperation of the circuit control system and the hydraulic station is beneficial to save manufacturing cost of the system.

4. According to the coiled tubing operating system of the present invention, the levelwind adopts a transmission mode formed by the drive motor—the one-stage chain transmission group—bidirectional screw rod, and the tubing counting device cooperates with the tubing encoder to measure the length of the coiled tube during tubing. Moreover, according to the coiled tubing operating system of the present invention, the levelwind drive of the levelwind is a drive motor, so that the levelwind drive can be controlled more simply and precisely. The drive motor has a faster response speed, and is cleaner. Compared with the hydraulic drive method, the levelwind of the present invention can prevent equipment and environment from pollution caused by hydraulic oil leakage, and avoid entangled and messy pipelines since the cables used in the present invention are less than the hydraulic pipelines used in the hydraulic drive method.

The levelwind generally comprises an automatic tubing operating system and a forced tubing operating system, while conventional levelwind generally adopts a transmission mode formed by mechanical transmission-two-stage chain transmission group-bidirectional screw rod for automatic tubing, and compares the mechanical transmission and the two-stage chain transmission group to measure the length of the coiled tube during tubing. Furthermore, the conventional levelwind generally adopts a transmission mode formed by hydraulic motor-first-stage chain transmission group-bidirectional screw rod for forced tubing, which means the conventional levelwind generally requires two sets of transmission systems.

According to the coiled tubing operating system of the present invention, the levelwind drive is connected to the tubing encoder, and the levelwind trolley is provided with a tubing technology device. Compared with a length measuring method which compares the mechanical transmission and the two-stage chain transmission group during tubing, the levelwind of the present invention can measure the length of the coiled tube through cooperation of the tubing counting device and the tubing encoder, thereby reducing a stage of chain transmission group, which also facilitates subsequent structure maintenance and inspection of the levelwind. At the same time, the levelwind of the present invention adopts the transmission mode formed by the drive motor—the one-stage chain transmission group-bidirectional screw rod, and the levelwind drive is connected to the tubing brake, so that forced tubing and automatic tubing are integrated in one system. That is to say, both the forced tubing and the automatic tubing of the levelwind of the present invention can be achieved by the transmission mode formed to by the drive motor—the one-stage chain transmission group-bidirectional screw rod. Therefore, the structure of the levelwind in the present invention is more compact and reasonable.

5. The coiled tubing operating system provided by the present invention also comprises a well control system, and the well control system is controlled by the circuit control system to monitor and forecast drilling parameters, well kicks and blowouts, thereby helping to ensure the quality of coiled tubing operating.

6. The coiled tubing operating system of the present invention further comprises a yard spooler, and the rewind device is driven by a motor, so that when rewinding the coiled tube, the yard spooler can be driven by the motor to significantly improve performance and efficiency. According to the coiled tubing operating system of the present invention, the yard spooler breaks the conventional structure which is driven by diesel engines and hydraulic motors, and the use of motor can improve energy consumption, reduce noise pollution, and avoid pollution from the hydraulic system. In addition, the yard spooler is driven by the motor, so that an encoder can be installed on the working motor, and the number of rotations of the drum can be accurately measured by the encoder. As a result, the yard spooler can automatically adapt to the operation requirements, thereby reducing manual operation and labor intensity.

7. The coiled tubing operating method provided by the present invention is based on the above-mentioned system for coiled tubing. The method controls and drives the injector assembly and the reel assembly through the circuit control system. Compared with conventional hydraulic transmission method, control precision of the circuit control system is higher, working stability of the injector assembly and the reel assembly is better, and environment pollution is reduced. Therefore, the method can ensure the stability of the coiled tubing operating, the precision of equipment control, and reduction of the environment pollution.

8. According to the coiled tubing operating method of the present invention, the load sensor, the depth-measuring encoder and the pressure sensor are installed on the injector assembly.

Therefore, the load sensor is used to monitor a load of the coiled tube during lowering or lifting in real time. A first threshold is set in advance in the circuit control system, which represents a maximum resistance value allowed by the coiled tubing during lowering or lifting. When the load is greater than the first threshold, the circuit control system will issue a system alarm and stop lowering or lifting. The operation can be continued after the operator has dealt with system alarm, so as to prevent the coiled tube from being stuck due to continuous lowering or lifting after encountering a resistance.

Therefore, the depth-measuring encoder is used to monitor a height of the coiled tube during lowering or lifting in real time. When the coiled tube reaches a preset second threshold, the injector assembly is controlled by the circuit control system to stop running, so as to prevent the coiled tube from being excessively lowered or lifted; wherein the second threshold represents a maximum height allowed by the coiled tubing operating system during lowering or lifting.

Therefore, the pressure sensor is used to detect a clamping force of a clamping system of the injector assembly. A third threshold and a fourth threshold are preset in the circuit control system. The third threshold represents a minimum clamping force of the clamping system in the injector assembly allowed by the coiled tubing during lowering or lifting. The fourth threshold represents a maximum clamping force of the clamping system in the injector assembly allowed by the coiled tubing during lowering or lifting. When the clamping force signal is less than the third threshold, the circuit control system controls the injector assembly to increase the clamping force of the clamping system. When the clamping force signal is greater than the fourth threshold, the circuit control system controls the injector assembly to reduce the clamping force of the clamping system. When the clamping force signal is between the third threshold and the fourth threshold, the clamping force is maintained. Therefore, the injector assembly can automatically adjust the clamping force of the clamping system, thereby reducing workload of the operator while satisfying equipment operation.

Figure 1:
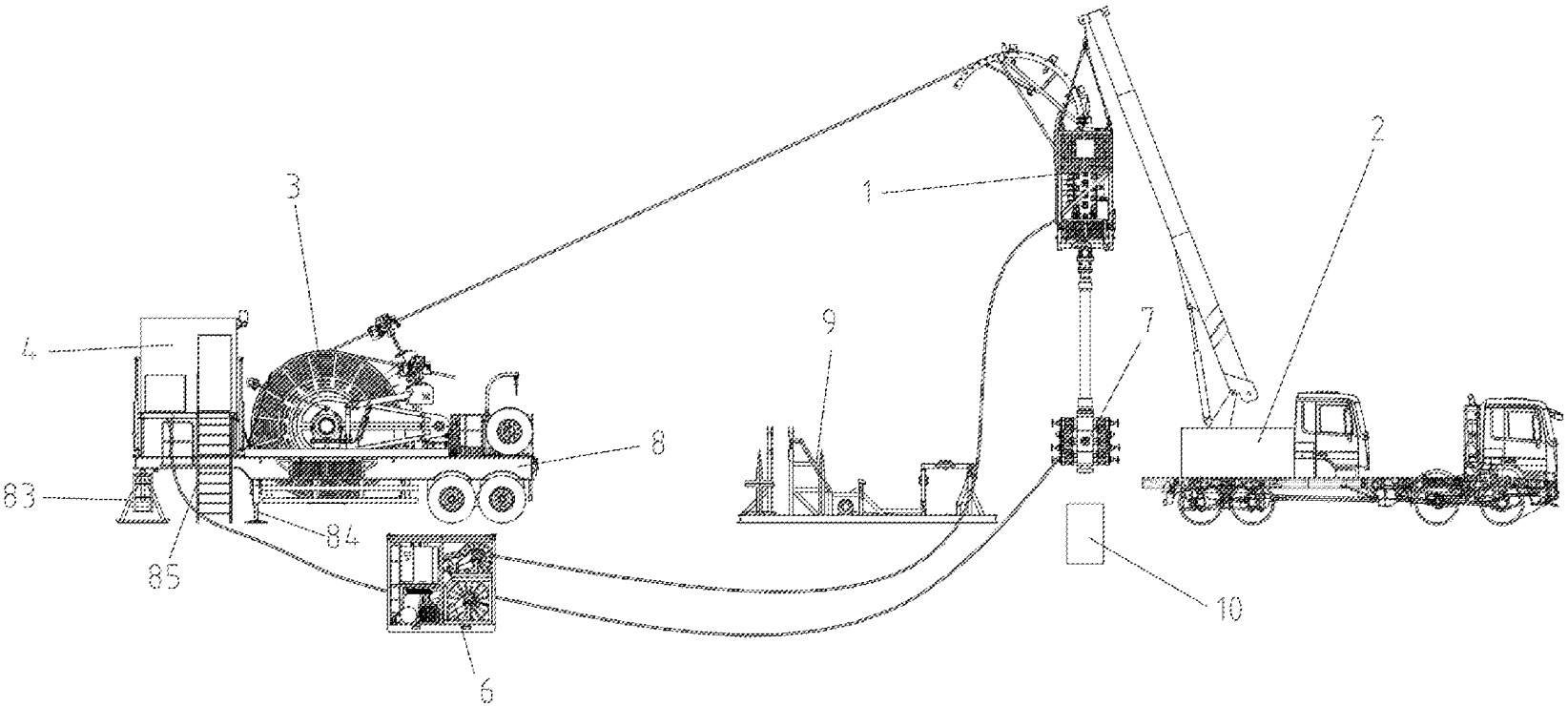
FIG. 1 is a structural view of an embodiment 1.

Element reference: 1—injector assembly, 11—drive device, 12—transmission assembly, 13—clamping system, 14—load sensor, 15—depth-measuring encoder, 16—pressure sensor, 17—gooseneck, 18—external frame, 2—suspending device, 3—teel assembly, 301—levelwind drive, 302—tubing counting device, 303—one-stage chain transmission group, 304—bidirectional screw rod, 305—levelwind trolley, 306—levelwind arm, 307—tubing encoder, 308—tubing brake, 309—drum body, 31—first support shaft assembly, 311—first support shaft, 312—transmission mechanism, 3121—driving wheel, 3122—driven wheel, 3123—transmission piece, 313—first support frame, 3131—first reinforcement piece, 32—second support shaft assembly, 321—second support shaft, 322—second support frame, 3221—second reinforcement piece, 33—working motor, 34—base frame, 4—electric control room, 41—integrated driller chair, 5—operation platform, 6—hydraulic station, 61—cable drum, 62—hose drum, 63—hydraulic pump, 7—well control system, 8—support platform, 81—traveling wheel, 82—connecting piece, 83—trailer supporter, 84—outrigger cylinder, 85—supporter ladder, 86—trailer, 9—installation skid, 10—operation well.

DETAILED DESCRIPTION OF THE PREFERRED EMBODIMENT

The present invention will be further described below with the accompanying drawings.

In order to make the objectives, technical solutions and advantages of the present invention clearer, the present invention will be further described below with the accompanying drawings and embodiments. It should be understood that the embodiments described herein are exemplary only and not intended to be limiting.

Embodiment 1

The embodiment 1 provides a coiled tubing operating system, which can ensure the stability of the coiled tubing, the precision of equipment control, and reduction of the environment pollution.

Referring to FIGS. 1-9, the embodiment 1 comprises: an injector assembly 1, a suspending device 2, a reel assembly 3, and a circuit control system; wherein the injector assembly 1 is used for lifting or lowering a coiled tube; the suspending device 2 is used for suspending the injector assembly 1; the reel assembly 3 is used for feeding the coiled tube to the injector assembly 1, and for rewinding the coiled tube from the injector assembly 1; the circuit control system of the embodiment 1 is connected to the injector assembly 1 and the reel assembly 3, for controlling movements of the injector assembly 1 and the reel assembly 3.

According to the embodiment 1, the suspending device 2 can suspend the injector assembly 1 above an operation well 10, so that during coiled tubing, the reel assembly 3 can feed the coiled tube to the injector assembly 1, thereby lowering the coiled tube into the operation well 10 through the injector assembly 1. After the coiled tubing is completed, the coiled tube is lifted by the injector assembly 1 from the operation well 10 and is rewound by the reel assembly 3.

The embodiment 1 controls and drives the injector assembly 1 and the reel assembly 3 through the circuit control system. Compared with conventional hydraulic transmission method, control precision of the circuit control system is higher, working stability of the injector assembly 1 and the reel assembly 3 is better, and environment pollution is reduced.

Therefore, the embodiment 1 can ensure the stability of the coiled tubing, the precision of equipment control, and reduction of the environment pollution.

Referring to FIGS. 1-5, the embodiment 1 further comprises an electric control room 4 and a generator, wherein the circuit control system comprises an operation platform 5, and the operation platform 5 is installed in the electric control room 4; the generator is used for powering the circuit control system.

Preferably, according to the embodiment 1, an integrated driller chair 41 can also be installed in the electric control room 4. The integrated driller chair 41 has a high degree of integration, which is easy to operate, intelligent, beautiful and comfortable, so as to greatly improve the convenience and comfort of operators.

Figure 5:
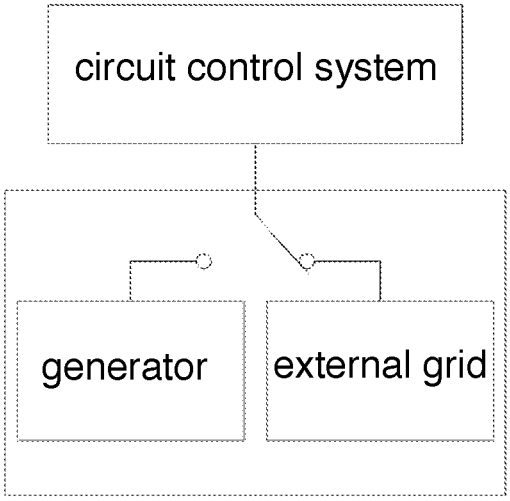
FIG. 5 is a sketch view of connecting a generator and an external grid to a circuit control system through a power switching according to the embodiment 1.
Figure 6:
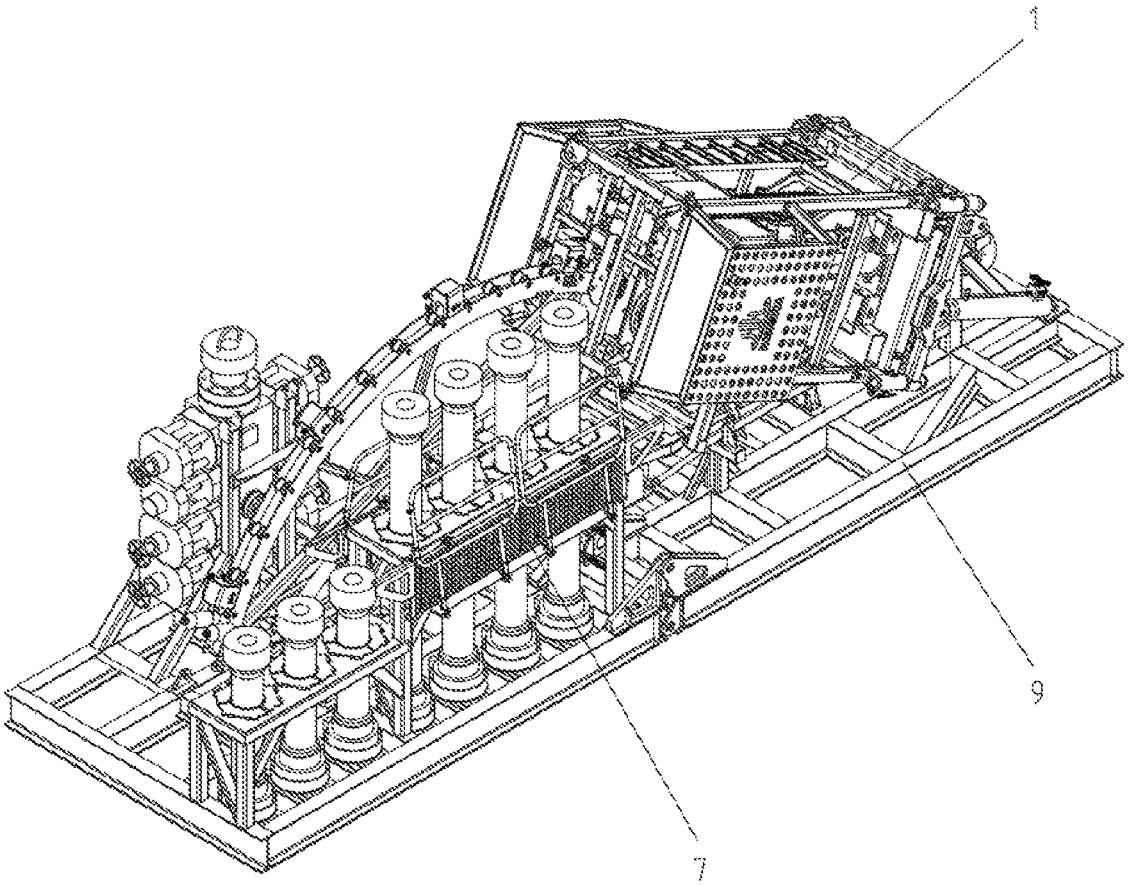
FIG. 6 is a structural view of a connection of an installation skid, an injector assembly and a well control system according to the embodiment 1.
Figure 7:
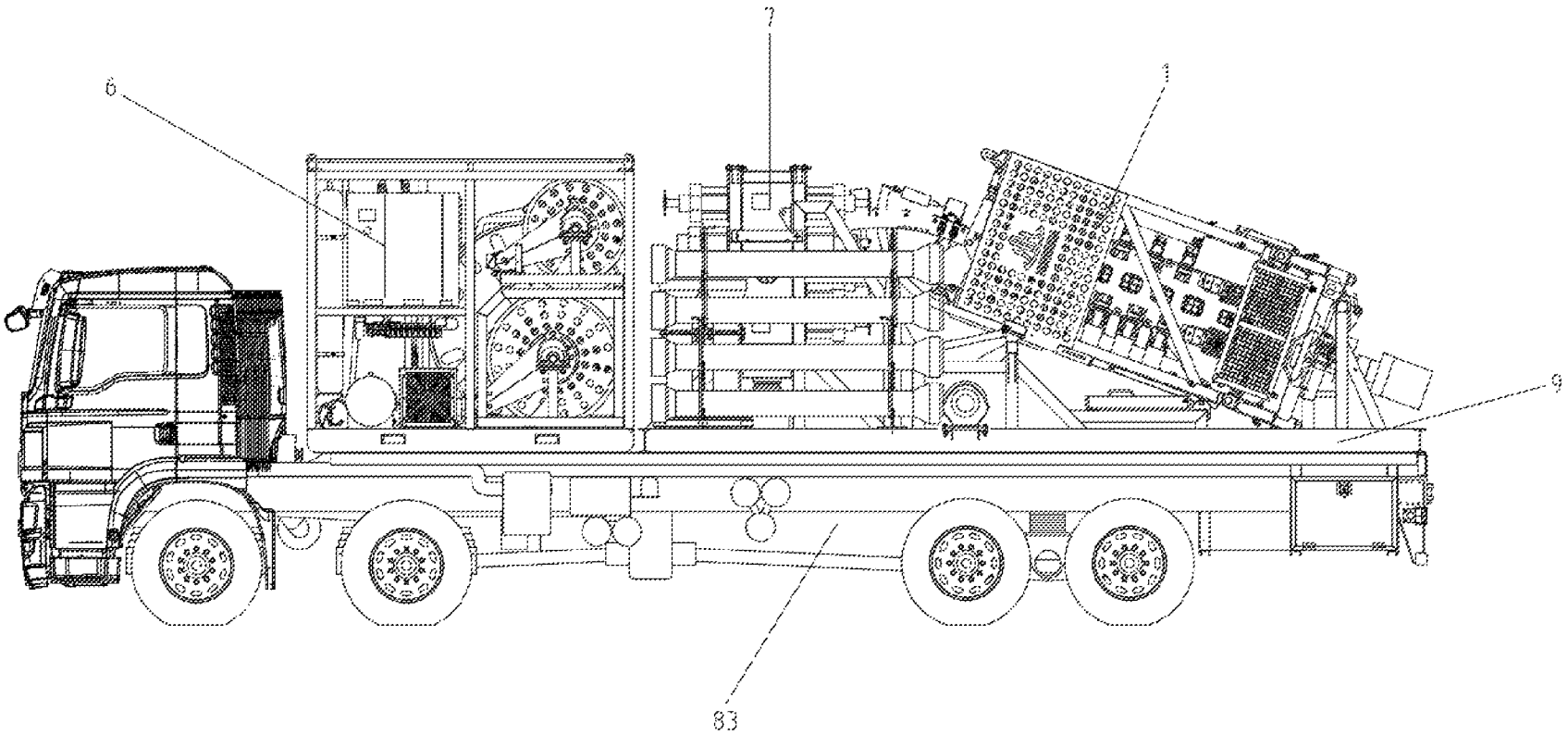
FIG. 7 is a sketch view of a hydraulic station and the installation skid carried by the trailer according to the embodiment 1.

Preferably, referring to FIG. 5, the embodiment 1 further comprises a power switching device, wherein the circuit control system is connected to an external grid through the power switching device, or the circuit control system is connected to the generator through the power switching device. As a result, the system of the embodiment 1 can be directly connected to and operated under the external grid. When the external grid fails, or when there is no external grid, the generator can supply power to the system of the embodiment 1.

Preferably, when there is an external grid, the external grid is connected to the circuit control system through the generator, so that when the external grid suddenly fails, the power source can be quickly switched to the generator to supply power to the system.

Referring to FIG. 1, the embodiment 1 further comprises a hydraulic station 6 connected to the injector assembly 1 and/or the reel assembly 3, wherein a control unit of the hydraulic station 6 is connected to the circuit control system, and the circuit control system controls the movements of the injector assembly 1 and/or the reel assembly 3 through the hydraulic station 6.

According to the embodiment 1, the circuit control system cooperates with the hydraulic station 6 to control executive elements of the system of the embodiment 1. Compared with a control method in which the executive elements are entirely controlled by the circuit control system, cooperation of the circuit control system and the hydraulic station 6 is beneficial to save manufacturing cost of the system. Specifically, according to the embodiment 1, the circuit control system cooperates with the hydraulic station 6 to control executive elements of the system of the embodiment 1, which means the circuit control system can operate the executive elements in the embodiment 1 through the hydraulic station 6; or the electric control system can directly operate some executive elements in the embodiment 1, and the hydraulic station 6 can directly operate the other executive elements in the embodiment 1. Of course, executive elements directly operated by the electric control system and the hydraulic station 6 can be selected according to actual situations.

Figure 8:
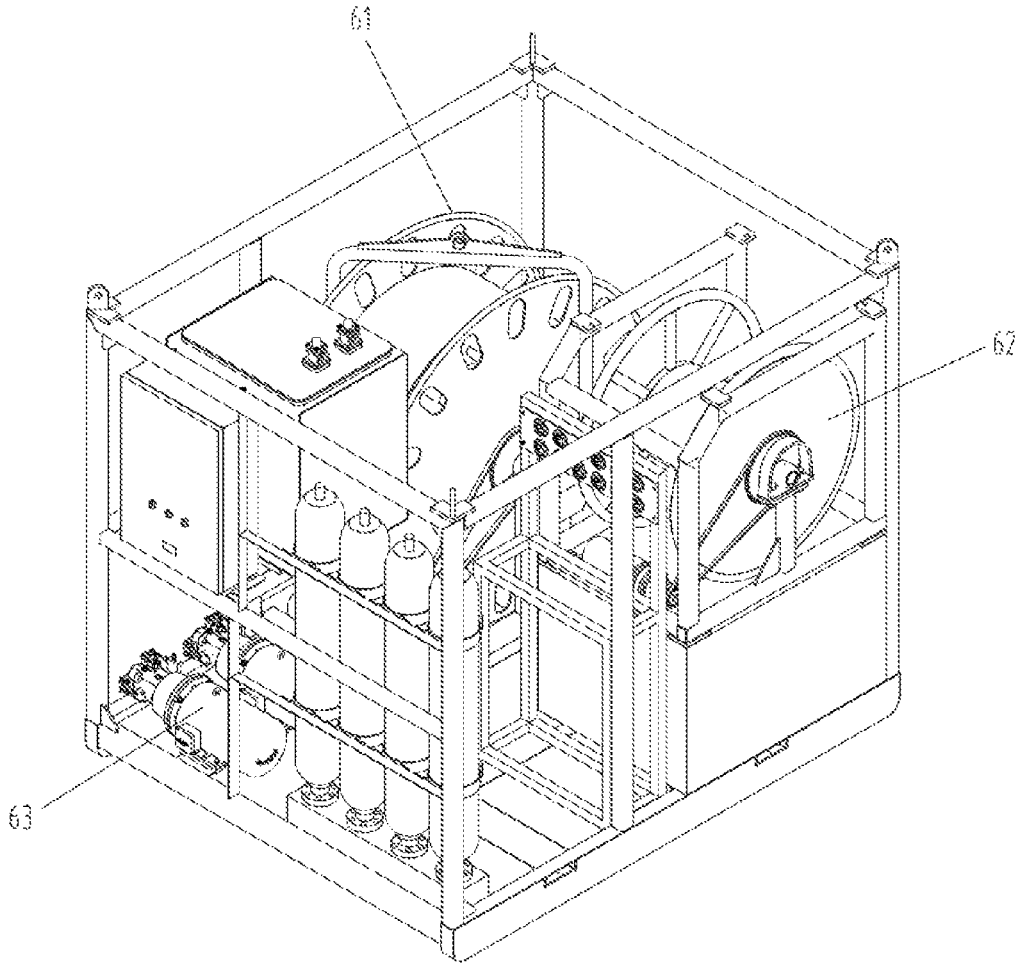
FIG. 8 is a structural view of the hydraulic station according to the embodiment 1.

Referring to FIG. 8, the hydraulic station 6 of the embodiment 1 comprises a cable drum 61, a hose reel 62 and a hydraulic pump 63, wherein the cable drum 61 is used for winding cables, and the hose reel 62 is used for winding hydraulic hoses; the circuit control system is electrically connected to the hydraulic pump 63, so as to control the movements of the injector assembly 1 and/or the reel assembly 3 through the hydraulic pump 63.

The hydraulic station 6 of the embodiment 1 comprises the hydraulic pump 63, and the circuit control system drives the hydraulic pump 63 to control the movements of the injector assembly 1 and/or the reel assembly 3. Compared with driving the hydraulic pump 63 through a diesel engine, the embodiment 1 drives the hydraulic pump 63 by the circuit control system, which can not only achieve stable operation and precise control of the embodiment 1, but also reduce environment pollution and noise during operation. Moreover, compared with driving the hydraulic pump 63 through a diesel engine, driving the hydraulic pump 63 by the circuit control system can greatly simplify the hydraulic system required in the embodiment 1, and further simplify an overall structure of the embodiment 1.

In addition, the embodiment 1 controls the hydraulic pump 63 by the circuit control system, so that performance and efficiency of coiled tubing can be greatly improved. Moreover, the hydraulic pump 63 is driven by the circuit control system, which can improve energy consumption, reduce noise pollution, and avoid pollution from the hydraulic system.

Figure 9:
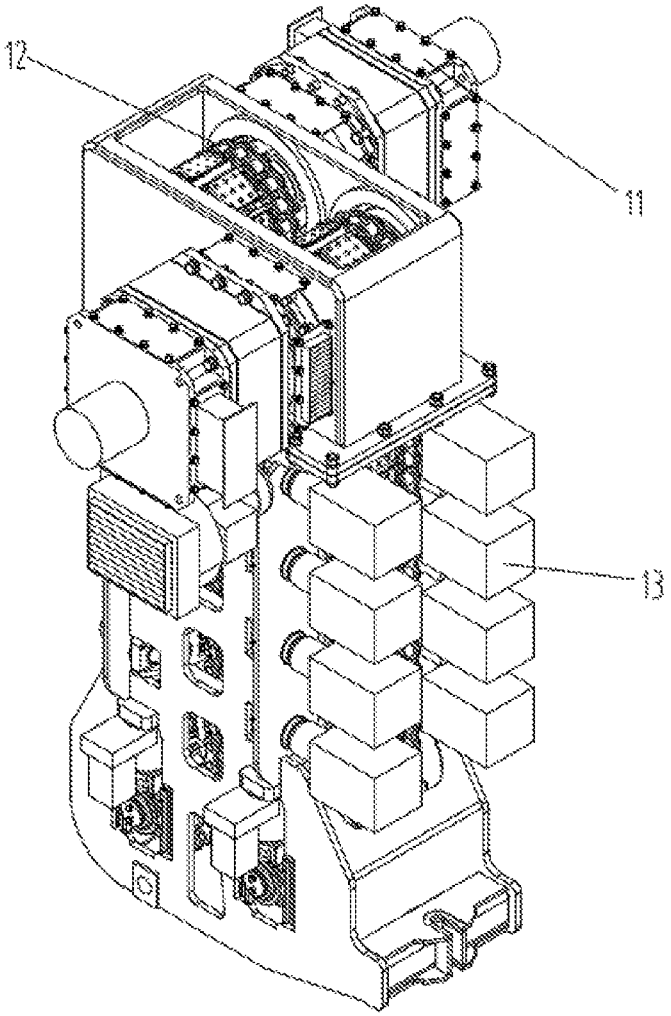
FIG. 9 is a structural view of the injector assembly (without gooseneck and external frame)
Figure 10:
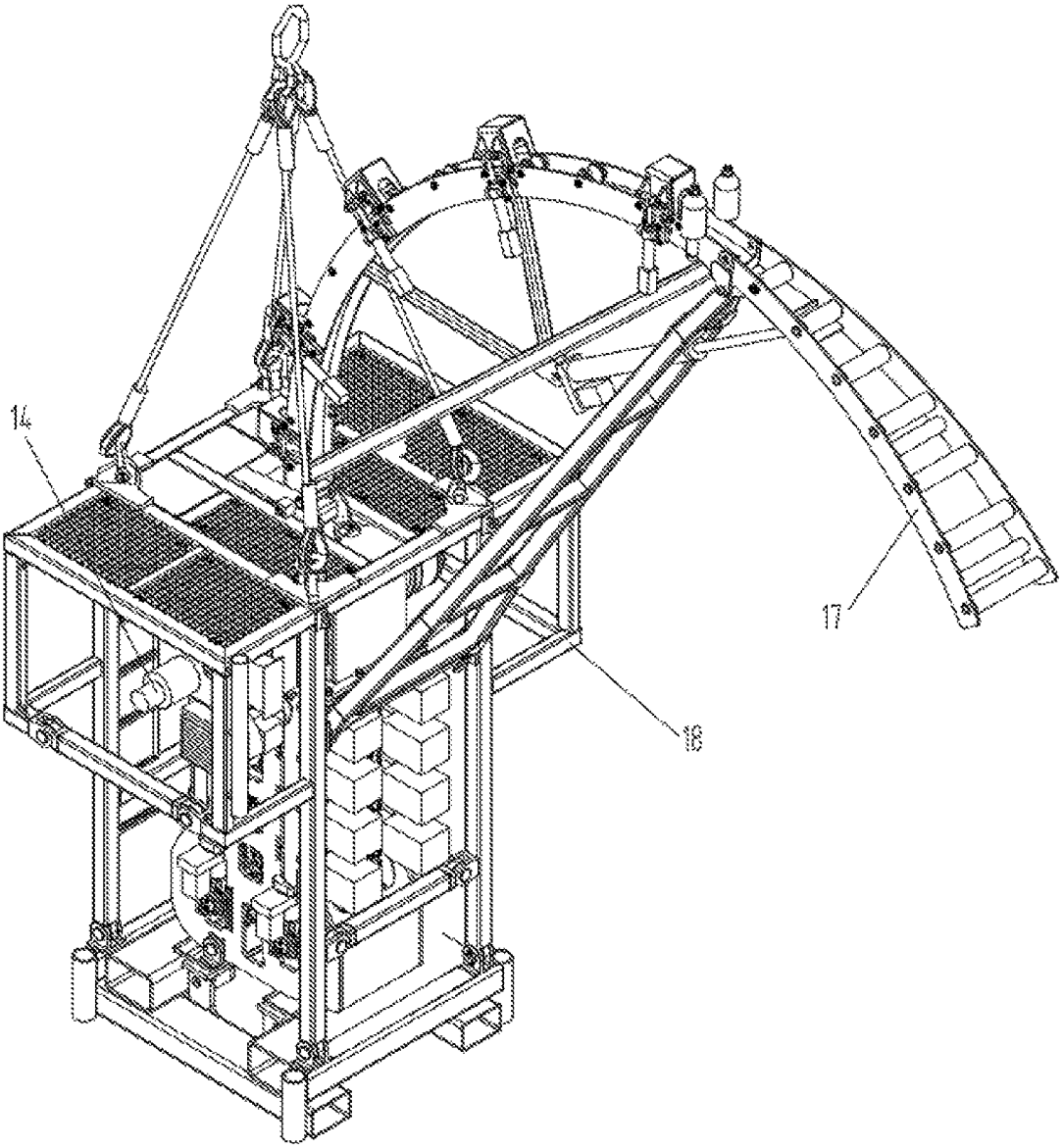
FIG. 10 is a structural view of the injector assembly (with a load sensor)
Figure 11:
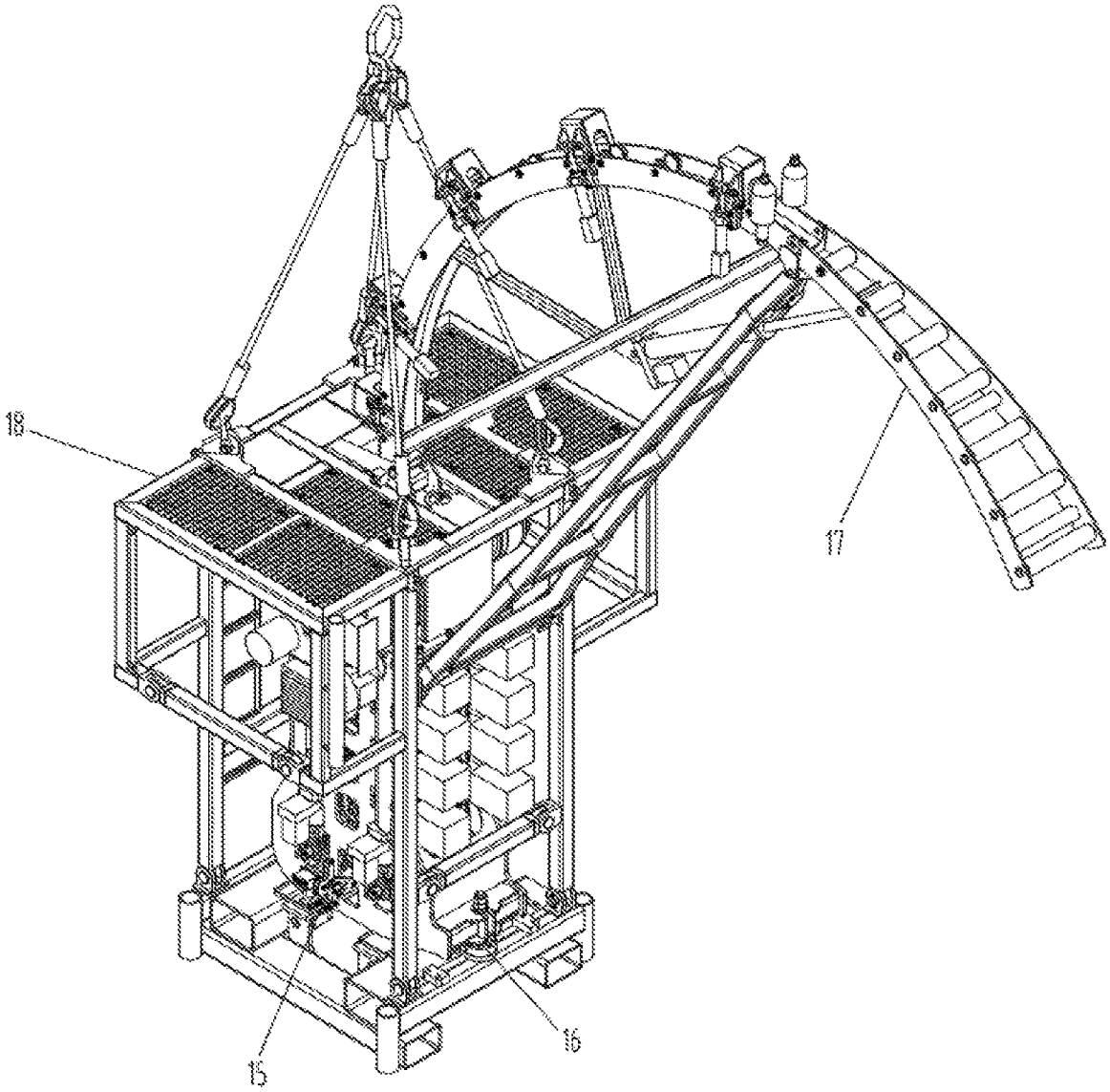
FIG. 11 is a structural view of the injector assembly (with a depth-measuring encoder and a pressure sensor)

According to the embodiment 1, referring to FIGS. 9-11, the injector assembly 1 comprises a driving device 11, a transmission assembly 12, an electric clamping system 13, an external frame 18, and a gooseneck 17, wherein the gooseneck 17 guides the coiled tube into the transmission assembly 12; the driving device 11 drives the transmission assembly 12 to move, thereby lifting or lowering the coiled tube; during lifting or lowering of the coiled tube, the electric clamping system 13 clamps the coiled tube.

According to the embodiment 1, a clamping system of the injector assembly 1 is the electric drive clamping system 13. Compared with a hydraulic clamping system, the electric clamping system 13 has a faster response speed, so that when the coiled tube slips, the injector assembly 1 of the embodiment 1 can respond quickly and increase the clamping force in time.

In addition, the clamping system of conventional injector assembly is hydraulically driven. When there is a power failure during suspending downhole, the conventional injector relies on a hydraulic system to maintain the suspension. However, pressure can only be maintained for a limited time, and the clamping system cannot be kept in a clamping state for a long time. According to the embodiment 1, the clamping system of the injector assembly 1 is the electric clamping system 13, wherein when power is normally supplied, the electric clamping system 13 can achieve torque retention; and when the power is cut off, the electric clamping system 13 can realize instant braking, and can clamp the coiled tube for a long time, so as to prevent the tube from falling into the well.

Preferably, the driving device 11 of the injector assembly 1 of the embodiment 1 is a drive motor. Unlike a hydraulic motor, the drive motor is still stable at a low speed, which can theoretically operate at a speed that is close to 0. Therefore, in the embodiment 1, a lifting or lowering speed for coiled tubing can be close to 0, so as to adapt to complicated operation conditions of coiled tubing. Furthermore, since the drive motor is capable of frequency conversion digital control and adjustment accuracy is high, the injector in the embodiment 1 can be accelerated and decelerated more smoothly. Moreover, replacing the hydraulic motor with the drive motor can reduce potential oil leakage on site, and can reduce on-site pollution.

According to the embodiment 1, the reel assembly 3 comprises an oil tube reel and a levelwind; wherein the oil tube reel comprises a reel drive, and the levelwind comprises a levelwind drive 301; the levelwind drive 301 adjusts a position of the coiled tube in the oil tube reel; the oil tube reel rewinds the coiled tube from the injector assembly 1 or from a yard spooler through the reel drive. Preferably, both the reel drive and the levelwind drive 301 adopt drive motors. The embodiment 1 breaks the conventional structure which is driven by diesel engines and hydraulic motors, and both the reel drive and the levelwind drive 301 of the reel assembly 3 adopt the drive motors. The use of motor can greatly improve the performance and efficiency, and can improve energy consumption, reduce noise pollution, and avoid pollution from the hydraulic system.

Figure 15:
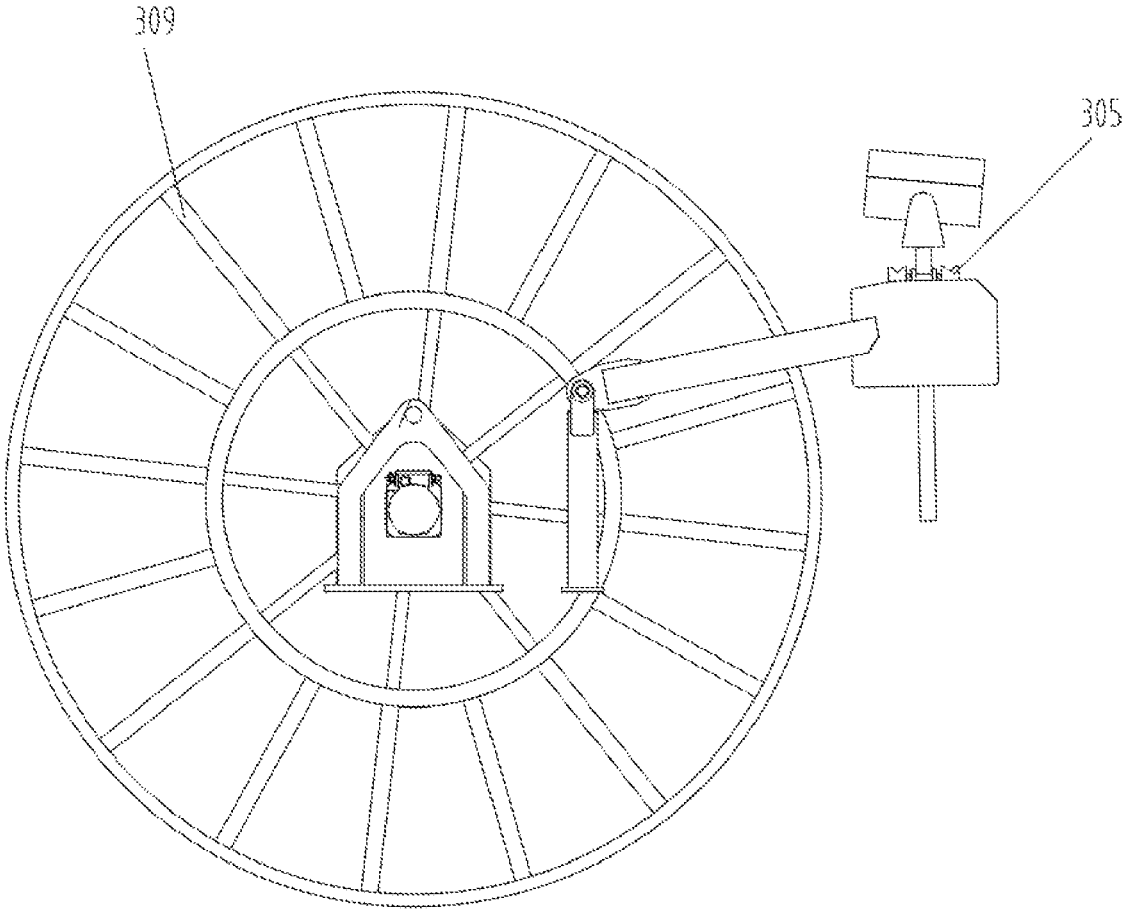
FIG. 15 is a front view of a levelwind.
Figure 16:
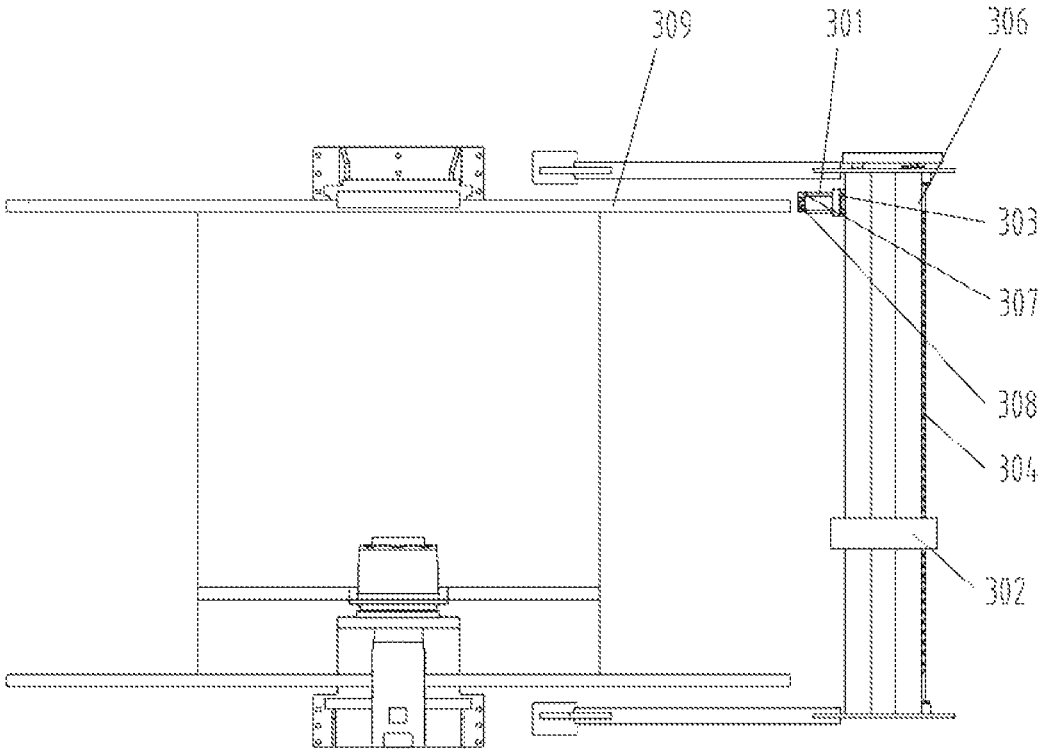
FIG. 16 is a side view of the levelwind.

Preferably, referring to FIGS. 15 and 16, the levelwind of the embodiment 1 is provided on a drum body 309. Specifically, the levelwind of the embodiment 1 comprises a levelwind drive 301, a tubing counting device 302, a one-stage chain transmission group 303, a bidirectional screw rod 304, a levelwind trolley 305, and a levelwind arm 306; wherein the levelwind drive 301 is drivingly connected to the one-stage chain transmission group 303; the one-stage chain transmission group 303 is connected to the bidirectional screw rod 304, and the bidirectional screw rod 304 is rotatably connected to the levelwind arm 306; the levelwind trolley 305 is connected to the bidirectional screw rod 304, and is slidably placed on the levelwind arm 306; the tubing counting device 302 is located on the levelwind trolley 305; the levelwind drive 301 is connected to a tubing encoder 307 and a tubing brake 308; the tubing encoder 307 communicates with the levelwind drive 301 and the tubing counting device 302 to measure a rotating speed of the levelwind drive 301; and the tubing brake 308 communicates with the levelwind drive 301 and the tubing counting device 302.

According to the embodiment 1, the levelwind adopts a transmission mode formed by the drive motor—the one-stage chain transmission group 303—bidirectional screw rod 304, and the tubing counting device 302 cooperates with the tubing encoder 307 to measure the length of the coiled tube during tubing. Moreover, according to the embodiment 1, the levelwind drive 301 of the levelwind is a drive motor, so that the levelwind drive 301 can be controlled more simply and precisely. The drive motor has a faster response speed, and is cleaner. Compared with the hydraulic drive method, the levelwind of the embodiment 1 can prevent equipment and environment from pollution caused by hydraulic oil leakage, and avoid entangled and messy pipelines since the cables used in the present invention are less than the hydraulic pipelines used in the hydraulic drive method.

The levelwind generally comprises an automatic tubing operating system and a forced tubing operating system, while conventional levelwind generally adopts a transmission mode formed by mechanical transmission-two-stage chain transmission group-bidirectional screw rod for automatic tubing, and compares the mechanical transmission and the two-stage chain transmission group to measure the length of the coiled tube during tubing. Furthermore, the conventional levelwind generally adopts a transmission mode formed by hydraulic motor-first-stage chain transmission group-bidirectional screw rod for forced tubing, which means the conventional levelwind generally requires two sets of transmission systems.

According to the embodiment 1, the levelwind drive 301 is connected to the tubing encoder 307, and the levelwind trolley 305 is provided with a tubing technology device. Compared with a length measuring method which compares the mechanical transmission and the two-stage chain transmission group during tubing, the levelwind of the embodiment 1 can measure the length of the coiled tube through cooperation of the tubing counting device 302 and the tubing encoder 307, thereby reducing a stage of chain transmission group, which also facilitates subsequent structure maintenance and inspection of the levelwind. At the same time, the levelwind of the embodiment 1 adopts the transmission mode formed by the drive motor—the one-stage chain transmission group 303—bidirectional screw rod 304, and the levelwind drive 301 is connected to the tubing brake 308, so that forced tubing and automatic tubing are integrated in one system. That is to say, both the forced tubing and the automatic tubing of the levelwind of the embodiment 1 can be achieved by the transmission mode formed by the drive motor—the one-stage chain transmission group 303—bidirectional screw rod 304. Therefore, the structure of the levelwind in the embodiment 1 is more compact and reasonable.

Figure 12:
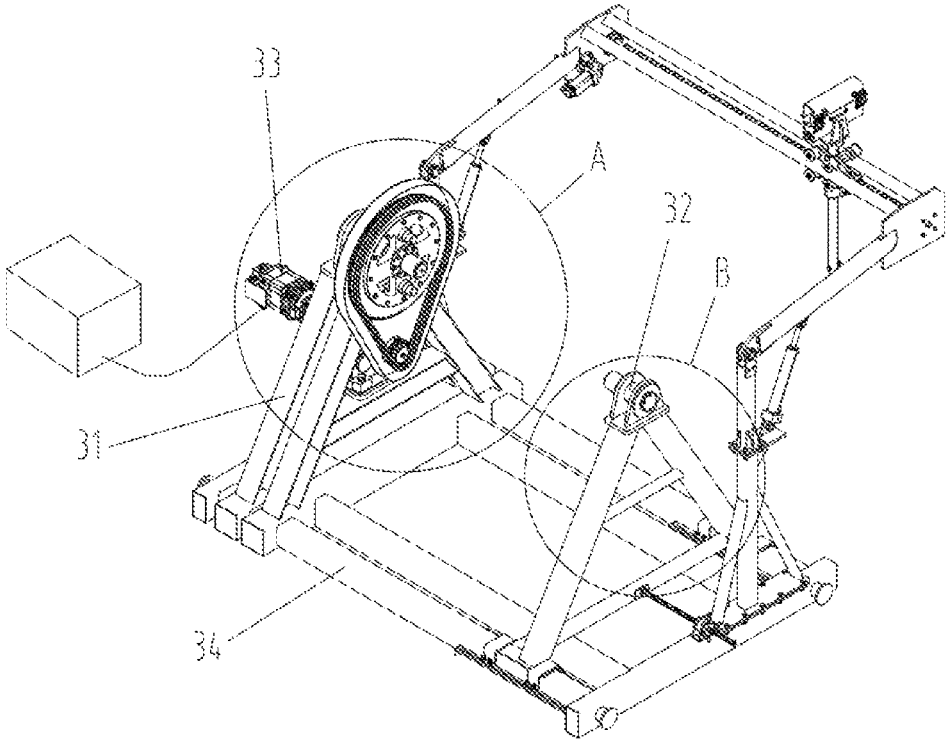
FIG. 12 is a structural view of a yard spooler according to the embodiment 1.
Figure 13:
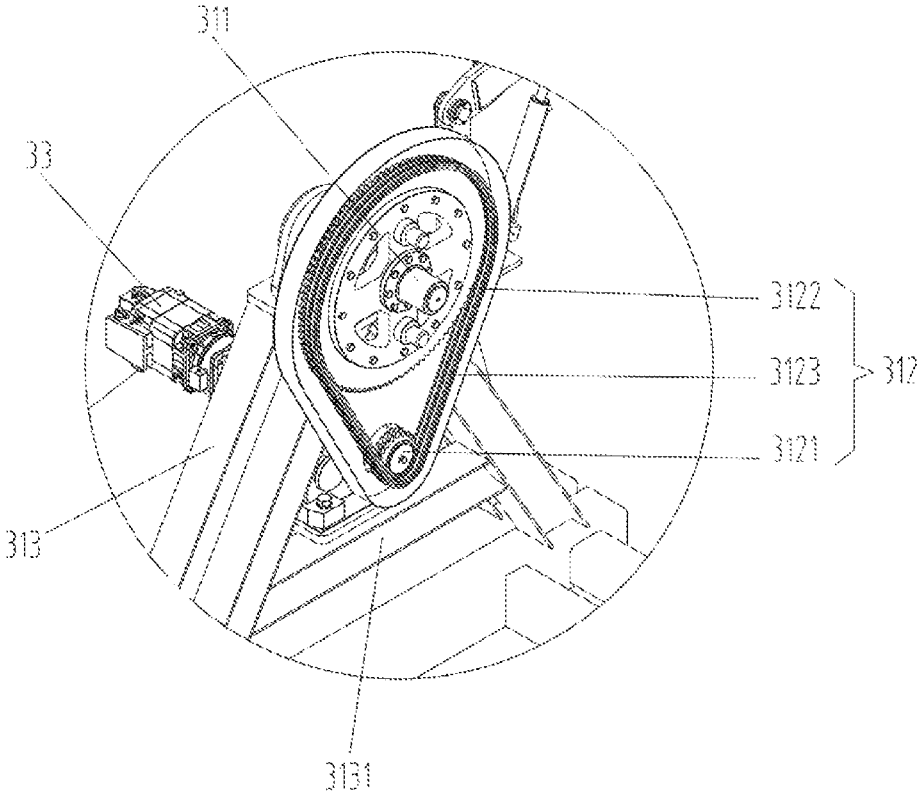
FIG. 13 is an enlarged view of part A in FIG. 12.
Figure 14:
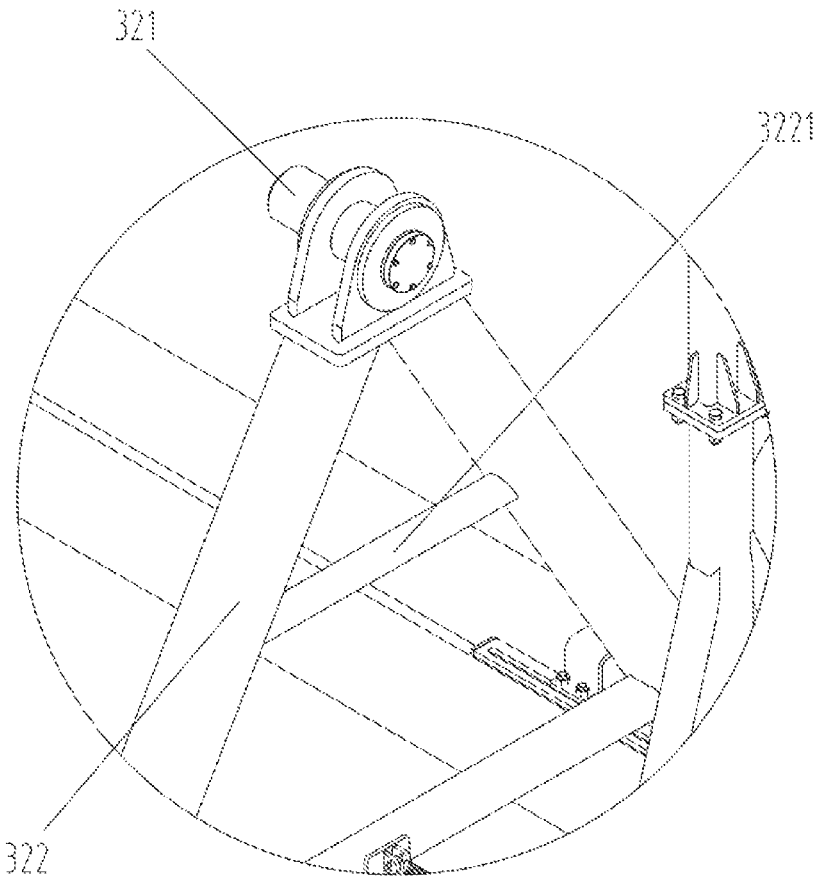
FIG. 14 is an enlarged view of part B in FIG. 12.

The embodiment 1 further comprises a yard spooler. Referring to FIGS. 12-14, the yard spooler comprises a first support shaft assembly 31, wherein the first support shaft assembly 31 comprises a first support shaft 311 and a transmission mechanism 312; the transmission mechanism 312 is connected to an output end of the working motor 33; the first support shaft 311 is installed on the transmission mechanism 312, and the working motor 33 drives the first support shaft 311 to rotate through the transmission mechanism 312.

Referring to FIGS. 12 and 14, a second support shaft assembly 32 of the yard spooler comprises a second support shaft 321; wherein the second support shaft 321 is coaxial with the first support shaft 311, and an installation area for the dump is formed between the first support shaft 311 and the second support shaft 321.

Specifically, referring to FIG. 12, the embodiment 1 further comprises a base frame 34. Referring to FIG. 13, the first support shaft assembly 31 further comprises a first support frame 313, and the transmission mechanism 312 is installed above the base frame 34 through the first support frame 313. Referring to FIGS. 12-14, the second support shaft assembly 32 further comprises a second support frame 322, and the second support shaft 321 is installed above the bottom frame 34 through the second support frame 322.

Referring to FIG. 13, the transmission mechanism 312 comprises a driving wheel 3121 and a driven wheel 3122. The driving wheel 3121 is installed at the output end of the working motor 33. The driving wheel 3121 is connected to the driven wheel 3122 a transmission piece 3123. The first support shaft 311 is installed on and coaxial with the driven wheel 3122. Preferably, the driving wheel 3121 is a smaller gear, the driven wheel 3122 is a large gear, and the transmission piece 3123 is a chain.

Referring to FIG. 12, the first support frame 313 and the second support frame 322 are both tripod structures, wherein the first support frame 313 is provided with a first reinforcement piece 3131, and the second support frame 322 is provided with a second reinforcement piece 3221. Specifically, the first reinforcement piece 3131 and the second reinforcement piece 3221 may adapt a rod-shaped structure or a column-shaped structure or the like.

According to the embodiment 1, the yard spooler breaks the conventional structure which is driven by diesel engines and hydraulic motors, and the use of motor can improve energy consumption, reduce noise pollution, and avoid pollution from the hydraulic system. In addition, the yard spooler is driven by the motor, so that an encoder can be installed on the working motor, and the number of rotations of the drum can be accurately measured by the encoder. As a result, the yard spooler can automatically adapt to the operation requirements, thereby reducing manual operation and labor intensity.

Preferably, referring to FIG. 1, the embodiment 1 further comprises a well control system 7, wherein the well control system 7 is installed below the injector assembly 1, and is connected to the circuit control system, so as to monitor and forecast drilling parameters, well kicks and blowouts with the well control system 7. As a result, coiled tubing quality can be guaranteed.

Referring to FIG. 1, the embodiment 1 further comprises a support platform 8, wherein a traveling wheel 81 is provided on one end of the support platform 8, and a connecting piece 82 is provided on the other end of the support platform 8 for connecting to a trailer; both the reel assembly 3 and the electric control room 4 are installed on the support platform 8; and the suspending device 2 is a crane, so that it is convenient to quickly transport different components of the embodiment 1, thereby realizing rapid assembly or disassembly of the t embodiment 1.

According to the embodiment 1, the specific structure of the support platform 8 is not limited, as long as it can facilitate the installation of the reel assembly 3 and the electric control room 4. The specific structure of the connecting piece 82 on the support platform 8 is not limited. For the convenience of implementation, the connecting piece 82 adopts a connecting shaft. Preferably, after the trailer 86 transports the support platform to a target position, in order to facilitate the stable placement of the support platform, as shown in FIG. 1, the embodiment 1 further comprises a trailer supporter 83 which is detachably connected to the connecting piece of the support platform. The specific connection manner of the trailer supporter 83 and the connecting piece is not limited, as long as the trailer supporter 83 can stably support the supporting platform. Preferably, the trailer supporter 83 can be screwed to the connecting piece. Preferably, in order to facilitate the connection between the trailer supporter 83 and the connecting piece, an outrigger cylinder 84 is also provided below the support platform, so that before the trailer supporter is connected to the connecting piece, the support platform can be lifted by the outrigger cylinder 84, thereby facilitating the connection of the trailer supporter 83 and the connecting piece. A supporter ladder 85 is also provided on the support platform of the embodiment 1, so that the operator can climb onto the support platform and enter the electric control room.

Figure 2:
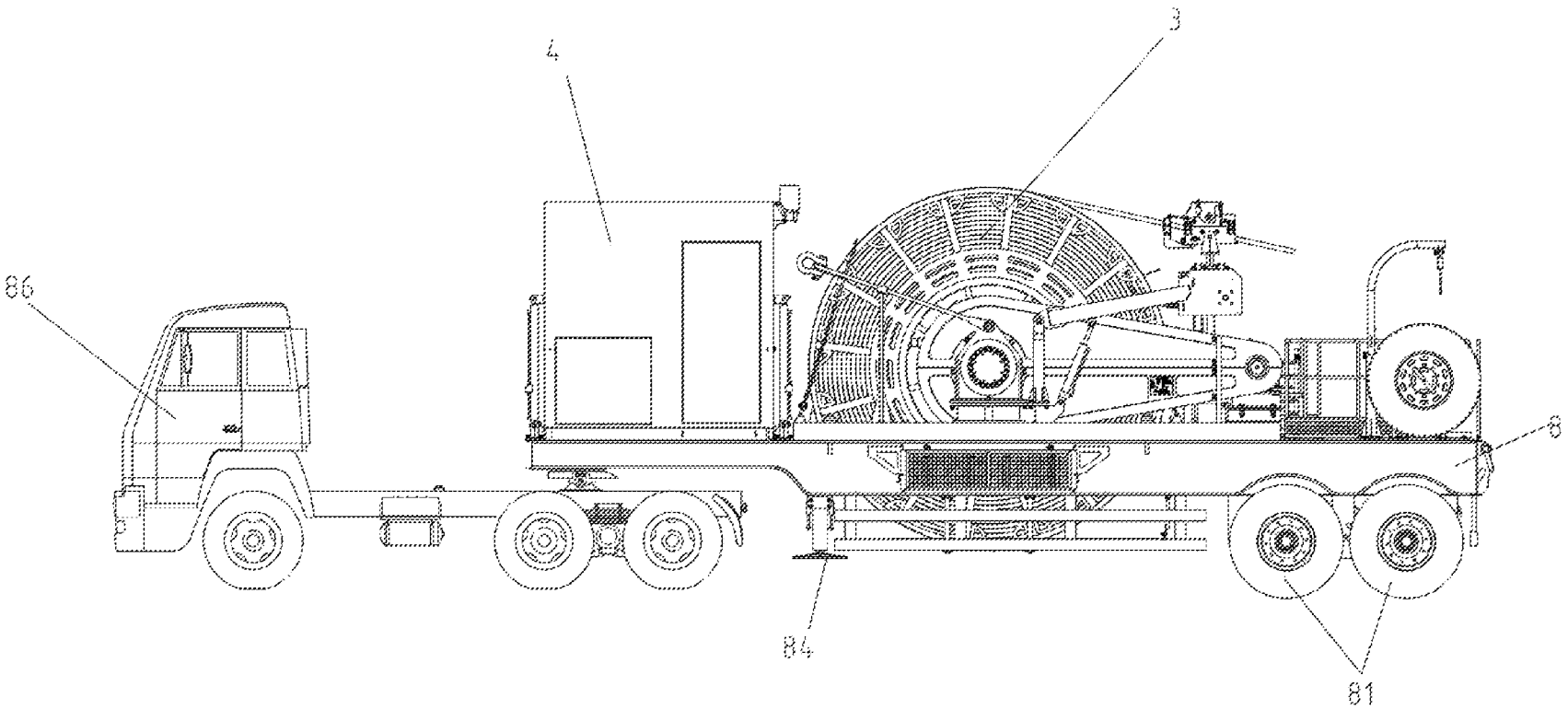
FIG. 2 is a structural view of a connection between a trailer and a support platform according to the embodiment 1.
Figure 3:
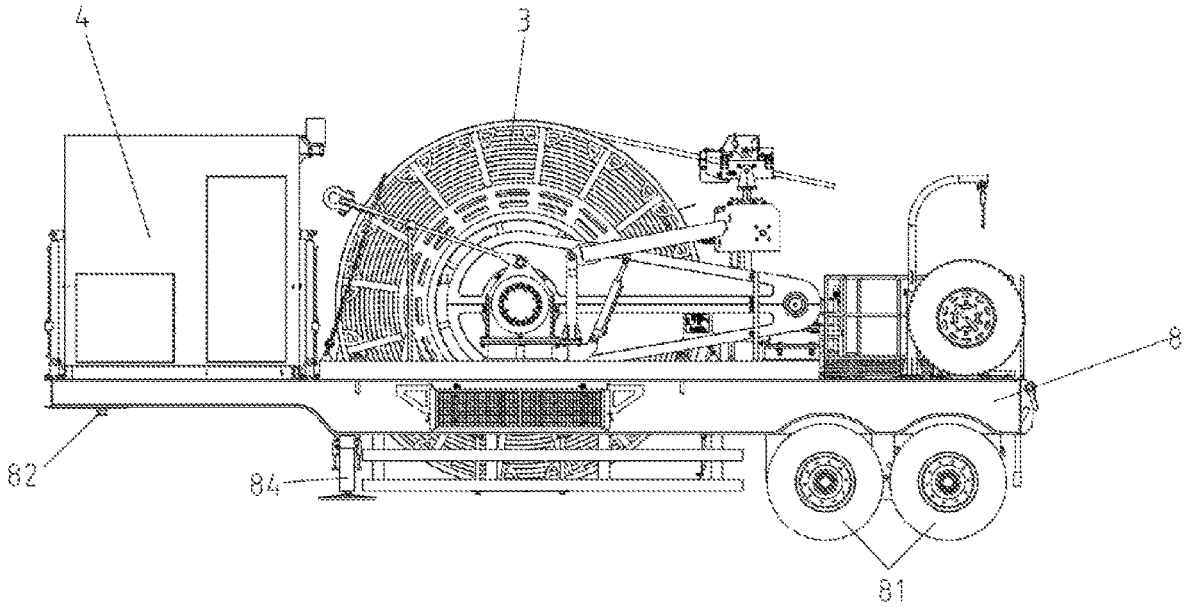
FIG. 3 is a structural view of a connection between the support platform, an electric control room and a reel assembly according to the embodiment 1.
Figure 4:
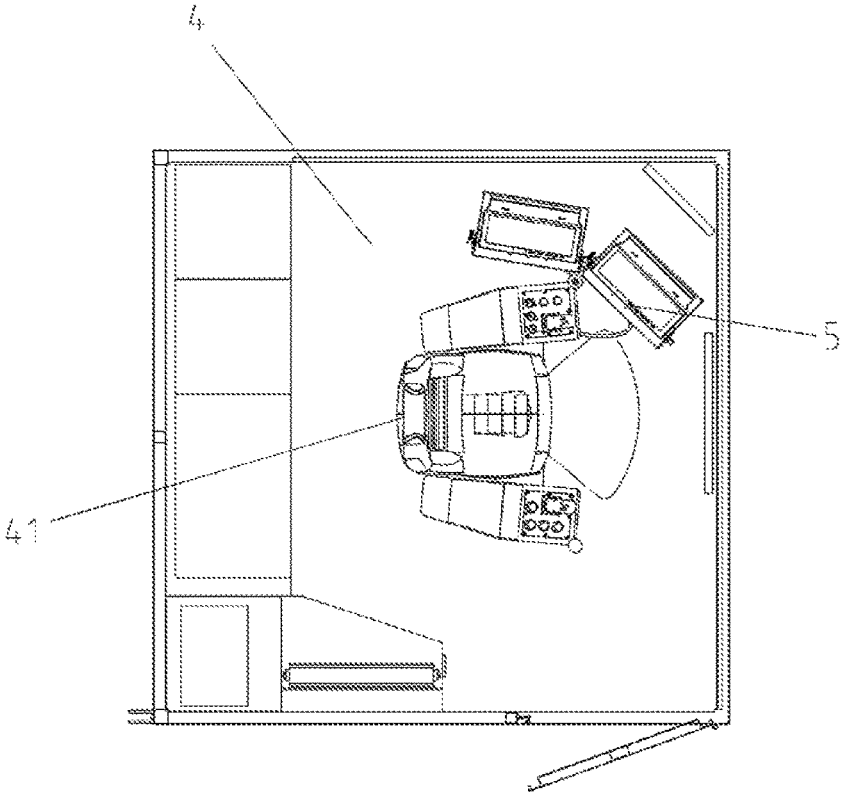
FIG. 4 is a top view of the electric control room according to the embodiment 1.

Referring to FIGS. 1-3, the embodiment 1 further comprises an installation skid 9, wherein the installation skid 9 has an injector installation area and a well control installation area; the injector assembly 1 is installed in the injector installation area, and a well control system 7 is installed in the well control installation area, so as to facilitate the connection of the injector assembly 1 and the well control system 7.

Embodiment 2

The embodiment 2 provides a coiled tubing operating method based on the coiled tubing operating system of the embodiment 1.

Specifically, the embodiment 2 comprises steps of:

S1, establishing the coiled tubing operating system of the embodiment 1 beside an operation well 10, and completing preparatory work before entering the operation well 10;

wherein the preparatory work comprises pulling and pressure tests of the coiled tube;

S2, according to target operation requirements, setting corresponding operation parameters in the circuit control system;

wherein the operation parameters comprise: a first threshold is set in the circuit control system, which represents a maximum resistance value allowed by the coiled tubing during lowering or lifting;

a second threshold set in the circuit control system, which represents a maximum height allowed by the coiled tubing during lowering or lifting; and a third threshold and a fourth threshold set in the circuit control system, wherein the third threshold represents a minimum clamping force of the clamping system 13 in the injector assembly 1 allowed by the coiled tubing during lowering or lifting; and the fourth threshold represents a maximum clamping force of the clamping system 13 in the injector assembly 1 allowed by the coiled tubing during lowering or lifting;

wherein in the step S2, when the drive device 11 in the injector assembly 1 is a drive motor and the clamping system 13 in the injector assembly 1 is an electric clamping system 13, the coiled tube can be lowered or lifted with stepless speed regulation, so that the lowering speed or lifting speed of the coiled tube can reach any required speed within a specified range during lowering or lifting the coiled tube;

S3, lowering the coiled tube to a designated position through the injector assembly 1 for operation;

S4, after the operation is completed, lifting the coiled tube to a wellhead of the operation well 10 through the injector assembly 1; and S5, closing the operation well 10, and disassembling the coiled tubing operating system.

During lowering or lifting the coiled tube, a load sensor 14 is installed on the injector assembly 1 of the embodiment 2, which is used to monitor a load of the coiled tube during lowering or lifting, and then feed back a load signal to the circuit control system; the circuit control system judges whether to continue lowering or lifting the coiled tube according to the load signal. Specifically, when the load monitored by the load sensor 14 is greater than the first threshold, the circuit control system will issue a system alarm and stop lowering or lifting. The operation can be continued after the operator has dealt with system alarm, so as to prevent the coiled tube from being stuck due to continuous lowering or lifting after encountering a resistance.

During lowering or lifting the coiled tube, a depth-measuring encoder 15 is installed on the injector assembly 1 of the embodiment 2, which is used to monitor a height of the coiled tube during lowering or lifting, and then feed back a height signal to the circuit control system; the circuit control system judges whether to continue lowering or lifting the coiled tube according to the height signal. Specifically, when the height monitored by the depth-measuring encoder 15 reaches the second threshold, the injector assembly 1 is controlled by the circuit control system to stop running, so as to prevent the coiled tube from being excessively lowered or lifted.

During lowering or lifting the coiled tube, a pressure sensor 16 is installed on the injector head assembly 1 of the embodiment 2, which is used to detect a clamping force of a clamping system 13 of the injector assembly 1, and then feed back a clamping force signal to the circuit control system. Specifically, When the clamping force monitored by the pressure sensor 16 is less than the third threshold, the circuit control system controls the injector assembly 1 to increase the clamping force of the clamping system 13; when the clamping force monitored by the pressure sensor 16 is greater than the fourth threshold, the circuit control system controls the injector assembly 1 to reduce the clamping force of the clamping system 13; and when the clamping force monitored by the pressure sensor 16 is between the third threshold and the fourth threshold, the clamping force is maintained. Therefore, the injector assembly can automatically adjust the clamping force of the clamping system, thereby reducing workload of the operator while satisfying equipment operation.

The coiled tubing operating method of the embodiment 2 is based on the coiled tubing operating system of the embodiment 1. Since the embodiment 1 controls and drives the injector assembly 1 and the reel assembly 3 through the circuit control system, compared with conventional hydraulic transmission method, control precision of the circuit control system is higher, working stability of the injector assembly 1 and the reel assembly 3 is better, and environment pollution is reduced. Therefore, the embodiment 2 can ensure the stability of the coiled tubing, the precision of equipment control, and reduction of the environment pollution.

The above descriptions are only preferred embodiments of the present invention and are not intended to be limiting Any modifications, equivalent replacements and improvements made within the spirit and principles of the present invention shall be included in the protection scope of the present invention.

What is claimed is:

1. A coiled tubing operating system, comprising:

an injector assembly (1) for lifting or lowering a coiled tube;

a suspending device (2) for suspending the injector assembly (1);

a reel assembly (3) for feeding the coiled tube to the injector assembly (1), and for rewinding the coiled tube from the injector assembly (1); and a circuit control system connected to the injector assembly (1) and the reel assembly (3), for controlling movements of the injector assembly (1) and the reel assembly (3);

wherein the reel assembly (3) comprises an oil tube reel and a levelwind; wherein the oil tube reel comprises a reel drive, and the levelwind comprises a levelwind drive (301); the levelwind drive (301) adjusts a position of the coiled tube in the oil tube reel; the oil tube reel rewinds the coiled tube from the injector assembly (1) or from a yard spooler through the reel drive;

wherein the levelwind further comprises a tubing counting device (302), a one-stage chain transmission group (303), a bidirectional screw rod (304), a levelwind trolley (305), and a levelwind arm (306);

wherein the levelwind drive (301) is drivingly connected to the one-stage chain transmission group (303);

the one-stage chain transmission group (303) is connected to the bidirectional screw rod (304), and the bidirectional screw rod (304) is rotatably connected to the levelwind arm (306);

the levelwind trolley (305) is connected to the bidirectional screw rod (304), and is slidably placed on the levelwind arm (306);

the tubing counting device (302) is located on the levelwind trolley (305);

the levelwind drive (301) is connected to a tubing encoder (307) and a tubing brake (308);

the tubing encoder (307) communicates with the levelwind drive (301) and the tubing counting device (302) to measure a rotating speed of the levelwind drive (301); and the tubing brake (308) communicates with the levelwind drive (301) and the tubing counting device (302).

2. The coiled tubing operating system, as recited in claim 1, further comprising an electric control room (4), and a generator for powering the circuit control system;

wherein the circuit control system comprises an operation platform (5), and the operation platform (5) is installed in the electric control room (4).

3. The coiled tubing operating system, as recited in claim 2, further comprising a power switching device, wherein the circuit control system is connected to an external grid through the power switching device, or the circuit control system is connected to the generator through the power switching device.

4. The coiled tubing operating system, as recited in claim 3, wherein when the external grid exists, the external grid is connected to the circuit control system through the generator.

5. The coiled tubing operating system, as recited in claim 2, further comprising a support platform (8), wherein a traveling wheel (81) is provided on one end of the support platform (8), and a connecting piece (82) is provided on the other end of the support platform (8) for connecting to a trailer; both the reel assembly (3) and the electric control room (4) are installed on the support platform (8);

the suspending device (2) is a crane.

6. The coiled tubing operating system, as recited in claim 5, further comprising an installation skid (9), wherein the installation skid (9) has an injector installation area and a well control installation area; the injector assembly (1) is installed in the injector installation area, and a well control system (7) is installed in the well control installation area.

7. The coiled tubing operating system, as recited in claim 1, further comprising a hydraulic station (6) connected to the injector assembly (1) and/or the reel assembly (3), wherein a control unit of the hydraulic station (6) is connected to the circuit control system, and the circuit control system controls the movements of the injector assembly (1) and/or the reel assembly (3) through the hydraulic station (6).

8. The coiled tubing operating system, as recited in claim 7, wherein the hydraulic station (6) comprises a cable drum (61), a hose reel (62) and a hydraulic pump (63), wherein the cable drum (61) is used for winding cables, and the hose reel (62) is used for winding hydraulic hoses; the circuit control system is electrically connected to the hydraulic pump (63), so as to control the movements of the injector assembly (1) and/or the reel assembly (3) through the hydraulic pump (63).

9. The coiled tubing operating system, as recited in claim 1, wherein the injector assembly (1) comprises a driving device (11), a transmission assembly (12) and an electric clamping system (13), wherein the driving device (11) drives the transmission assembly (12) to move, thereby lifting or lowering the coiled tube; during lifting or lowering of the coiled tube, the electric clamping system (13) clamps the coiled tube.

10. The coiled tubing operating system, as recited in claim 1, further comprising a yard spooler, which comprises a first support shaft (311), a working motor (33), a first support shaft assembly (31) and a second support shaft assembly (32), wherein the first support shaft (311) is used to rotate a drum, and the working motor (33) is drivingly connected to the first support shaft (311);

the first support shaft assembly (31) comprises a transmission mechanism (312) and the first support shaft (311); the working motor (33) is drivingly connected to the first support shaft (311) through the transmission mechanism (312);

the second support shaft assembly (32) is arranged apart from the first support shaft assembly (31), and comprises a second support shaft (321); wherein the second support shaft (321) is coaxial with the first support shaft (311), and an installation area for the drum is formed between the first support shaft (311) and the second support shaft (321).

11. The coiled tubing operating system, as recited in claim 1, further comprising a well control system (7), wherein the well control system (7) is installed below the injector assembly (1), and is used to monitor and forecast drilling parameters, well kicks and blowouts; the well control system (7) is connected to the circuit control system.

12. A coiled tubing operating method based on the coiled tubing operating system as recited in claim 1, comprising steps of:

S1, establishing the coiled tubing operating system, and completing preparatory work before entering an operation well (10);

S2, according to target operation requirements, setting corresponding operation parameters in the circuit control system;

S3, lowering the coiled tube to a designated position through the injector assembly (1) for operation;

S4, after the operation is completed, lifting the coiled tube to a wellhead of the operation well (10) through the injector assembly (1); and S5, closing the operation well (10), and disassembling the coiled tubing operating system.

13. The coiled tubing operating method, as recited in claim 12, wherein a load sensor (14) is installed on the injector assembly (1), which is used to monitor a load of the coiled tube during lowering or lifting, and then feed back a load signal to the circuit control system;

the circuit control system judges whether to continue lowering or lifting the coiled tube according to the load signal, so as to prevent the coiled tube from being stuck due to continuous lowering or lifting after encountering a resistance.

14. The coiled tubing operating method, as recited in claim 12, wherein a depth-measuring encoder (15) is installed on the injector assembly (1), which is used to monitor a height of the coiled tube during lowering or lifting, and then feed back a height signal to the circuit control system;

the circuit control system judges whether to continue lowering or lifting the coiled tube according to the height signal, so as to prevent the coiled tube from being excessively lowered or lifted.

15. The coiled tubing operating method, as recited in claim 12, wherein a pressure sensor (16) is installed on the injector head assembly (1), which is used to detect a clamping force of a clamping system of the injector assembly (1), and then feed back a clamping force signal to the circuit control system;

the circuit control system adjusts the clamping force of the clamping system of the injector assembly (1) according to the clamping force signal.

* * * * *